United States Patent [19]

Guptill

[11] Patent Number: 5,018,997

[45] Date of Patent: May 28, 1991

[54] SKEG PROTECTOR

[75] Inventor: Brian N. Guptill, Falcon Lake, Canada

[73] Assignees: M & J MacIver Holdings Ltd.; Marr's Leisure Products (1977) Inc., both of Winnipeg, Canada; a part interest

[21] Appl. No.: 536,356

[22] Filed: Jun. 11, 1990

[51] Int. Cl.[5] ..... B63H 21/24

[52] U.S. Cl. ..... 440/76; 114/219

[58] Field of Search ..... 114/219, 149, 162, 140, 114/127; 440/66, 67, 71, 72, 73, 78, 900

[56] References Cited

U.S. PATENT DOCUMENTS

| | | | |
|---|---|---|---|
| 2,706,461 | 4/1955 | Smith | 440/65 |
| 4,565,533 | 1/1986 | Springer | 440/71 |
| 4,925,412 | 5/1990 | Karls | 440/71 |

FOREIGN PATENT DOCUMENTS

| | | | |
|---|---|---|---|
| 0131690 | 11/1978 | Japan | 440/78 |

*Primary Examiner*—Ed Swinehart

*Attorney, Agent, or Firm*—Murray E. Thrift; Stanley G. Ade; Adrian D. Battison

[57] ABSTRACT

A skeg protector is mounted on the leading edge of the skeg of a boat motor. The protector is in the form of a channel of stainless steel fitted on the skeg with the base of the channel spaced forwardly of the leading edge of the skeg. A rubber strip extends along the inside of the channel. To mount the protector on the skeg, elongate, horizontal slots are formed in the channel flanges and holes are drilled through the skeg in line with the slots. Dome head machine screws and nuts are fastened through the slots and the bores of the skeg. These slots allow the skeg protector to yield somewhat on impact with a submerged object.

12 Claims, 1 Drawing Sheet

FIG. 1
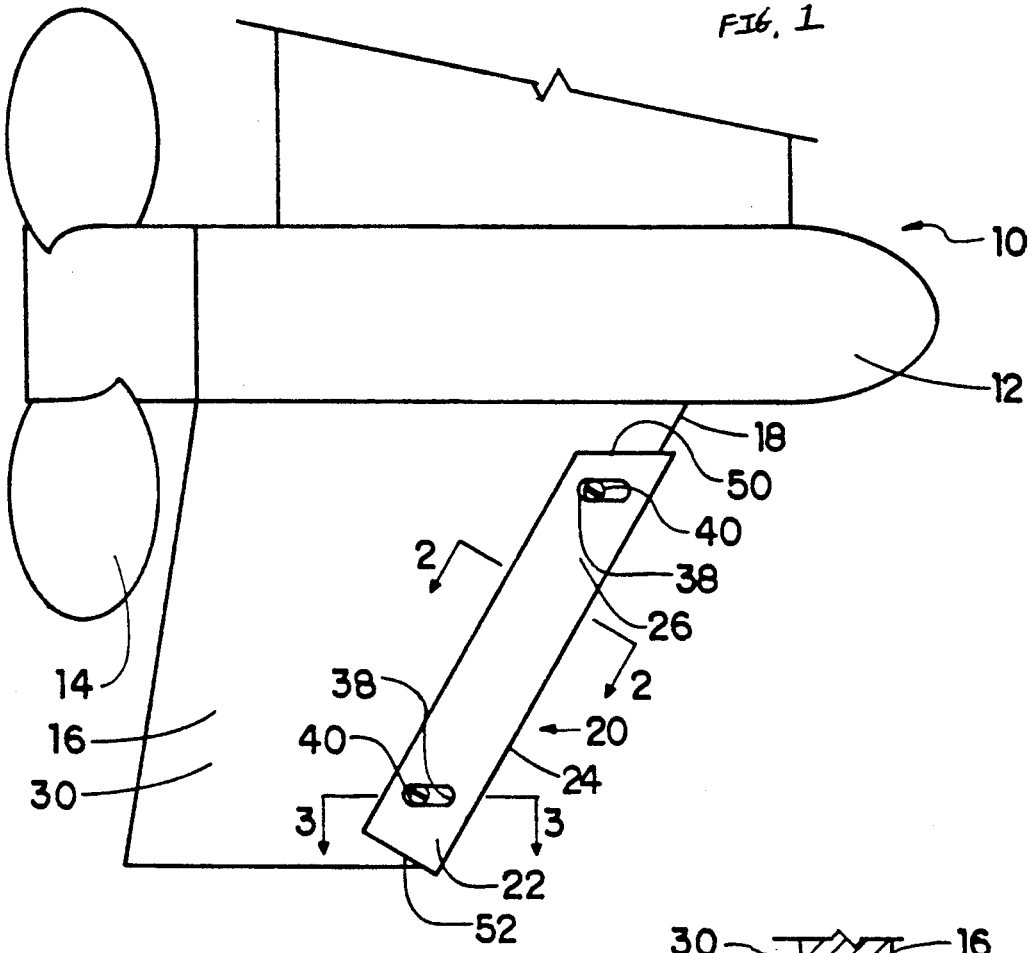
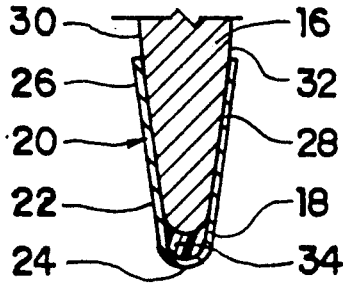
FIG. 2
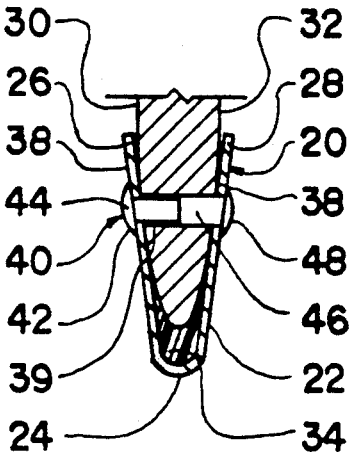
FIG. 3

SKEG PROTECTOR

FIELD OF THE INVENTION

The present invention relates to boat motors and more particularly to the protection of skegs on outboard and inboard-outboard motors.

BACKGROUND

The skeg of a boat motor is a fin that extends vertically down from the propeller shaft housing. It is exposed to damage by impact with rocks and other submerged objects. Skegs can be severally damaged or even broken off depending on the severity of impact with a submerged object. Damaged skegs can often be repaired, but this is costly. When a skeg is broken off, and a significant portion is lost, a replacement is required, again at significant cost.

The objective of the present invention is to provide a skeg protector.

SUMMARY

According to the present invention there is provided a skeg protector comprising a v-shaped channel with a leading edge and two flanges diverging therefrom, and means for securing the channel over a leading edge of a skeg.

The channel is fitted onto the leading edge of a skeg and is bolted to the skeg. In preferred embodiments, a resilient strip is fitted between the leading edge of the skeg and the channel, and the channel is mounted on the skeg through horizontal slots in the channel. This allows the protector to give slightly with impact to reduce the transmission of shock loadings to the skeg.

It is preferred that the protector is made of stainless steel so that it is resistant to corrosion.

According to another aspect of the invention there is provided a boat motor equipped with the skeg protector.

BRIEF DESCRIPTION OF THE DRAWINGS

In the accompanying drawings, which illustrate an exemplary embodiment of the present invention:

FIG. 1 is a side elevation of the lower end of a boat motor equipped with a skeg protector;

FIG. 2 is a section along line 2—2 of FIG. 1; and

FIG. 3 is a section along line 3—3 of FIG. 1.

DETAILED DESCRIPTION

Referring to the accompanying drawings and especially to FIG. 1 there is illustrated the final drive of a boat motor 10. This includes a propeller shaft housing 12, a propeller 14 behind the shaft housing and a skeg 16 in the form of a vertical fin extending downwardly from the housing 12. The skeg has a leading edge 18 that is fitted with a protector 20 to reduce damage to the skeg from impact with submerged objects.

The skeg protector 20 includes a channel 22 of stainless steel. The channel has a leading edge 24 and two flanges 26 and 28 that diverge from the leading edge. The channel is fitted over the leading edge 18 of the skeg with the flanges 26 and 28 in engagement with the side faces 30 and 32 of the skeg. A rubber strip 34 is fitted into the base of the channel 22, along the leading edge 18 of the skeg.

Two pairs of slots 36 and 38 are formed in the channel 22. The slots of each pair are aligned and formed in respective ones of the flanges 26 and 28. As illustrated most particularly in FIG. 3, a bore 39 extends through the skeg in alignment with each pair of slots and a fastener 40 extends through the slots and the bore to fasten the channel 22 to the skeg. The fastener includes a machine screw 42 with a flattened, oval head 44 and a sleeve-like nut 46 with a flattened, dome head 48. The low profile heads of the machine screws and nuts are intended to provide a minimal resistance to flow past the skeg protector.

The channel 22 has a top edge 50 that is arranged at an acute angle to the leading edge 24. In the illustrated embodiment, this makes the top edge 50 horizontal, which is the preferred orientation. The top edge is parallel to the slots 36 and 38. The bottom edge 52 of the channel 22 is arranged generally at right angles to the leading edge 24. It extends about ¼ inch below the skeg to protect the lower front corner.

With the skeg protector installed as illustrated, any impact on the channel 22 by a submerged object will have a direct affect on the protector 20 rather than on the skeg. The stainless steel of the channel 22 is physically strong and resistant to damage. Because of the slots 36 and 38 and the resilient strip 34, the channel 22 is allowed to move somewhat on the skeg and to absorb some of the impact thus reducing shock loadings on the skeg itself.

Where an impact on a skeg is sufficient to actually break the skeg, the fasteners 40 and the channel 22 will usually remain fastened to both the stub of the skeg and the broken off piece, so that the broken off part of the skeg is not lost and can be welded back in place at significantly less cost than the purchase of a new unit.

The skeg protectors can be manufactured and sold in a range of sizes, with four standard sizes being sufficient to fit most outboard and inboard-outboard motors.

While one embodiment of the present invention has been described in the foregoing, it is to be understood that other embodiments are possible within the scope of the invention. The invention is to be considered limited solely by the scope of the appended claims.

I claim:

1. A skeg protector comprising a v-shaped channel with a leading edge and two flanges diverging therefrom, securing means for securing the channel over a leading edge of a skeg, said securing means comprising pairs of aligned, elongate, parallel slots, oriented at an acute angle to the leading edge, the slots of each pair being in respective ones of the flanges and fasteners extending through the pairs of slots, and a resilient strip extending along the inside of the channel, between the flanges for resiliently biassing the channel away from the leading edge of the skeg on which the protector is mounted.

2. A skeg protector according to claim 1 wherein the channel is made from stainless steel.

3. A skeg protector according to claim 1 wherein the fasteners comprise machine screws and dome nuts.

4. A skeg protector according to claim 1 wherein the channel has a top edge oriented at an acute angle to the leading edge.

5. A skeg protector according to claim 4 wherein the channel has a bottom edge oriented substantially at right angles to the leading edge.

6. A skeg protector according to claim 5 wherein the slots are parallel to the top edge of the channel.

7. In a boat motor having a skeg with a leading edge, a skeg protector comprising a v-shaped channel with a leading edge and two flanges diverging therefrom, the channel engaging over the leading edge of the skeg, with the flanges thereof engaging opposite sides of the skeg and the leading edge of the channel spaced from the leading edge of the skeg, securing means securing the channel to the skeg comprising pairs of aligned, elongate, substantially horizontal slots, the slots of each pair being in respective ones of the flanges, bores through the skeg aligned with the respective pairs of slots, and fasteners extending through the slots and bores, and a resilient strip between the leading edge of the skeg and the channel whereby on impact of the skeg protector with an underwater object, the skeg will move towards the skeg, compressing the resilient strip, and displacing the fasteners along the slots.

8. The invention according to claim 7 wherein the channel is made from stainless steel.

9. The invention according to claim 7 wherein the fasteners comprise oval head machine screws and dome nuts.

10. The invention according to claim 7 wherein the channel has a top edge oriented at an acute angle with respect to the leading edge thereof.

11. The invention according to claim 10 wherein the channel has a bottom edge oriented substantially at right angles with respect to the leading edge.

12. The invention according to claim 11 wherein the slots are parallel to the top edge.

* * * * *